United States Patent [19]

Litchfield et al.

[11] 4,190,306

[45] Feb. 26, 1980

[54] DRAWER WITH STOP DEVICE

[75] Inventors: Leon G. Litchfield; Terence Hardy, both of Derby, England

[73] Assignee: L. B. (Plastics) Limited, Derby, England

[21] Appl. No.: 892,741

[22] Filed: Apr. 3, 1978

[30] Foreign Application Priority Data

Apr. 6, 1977 [GB] United Kingdom ..... 14495/77
Jul. 23, 1977 [GB] United Kingdom ..... 31040/77

[51] Int. Cl.[2] ..... A47B 88/00

[52] U.S. Cl. ..... 312/330 R; 312/333; 312/348

[58] Field of Search ..... 312/330 R, 333, 348, 312/349; 292/145, 147

[56] References Cited

U.S. PATENT DOCUMENTS

| | | | |
|---|---|---|---|
| 441,308 | 11/1890 | Kenney | 312/348 |
| 1,023,455 | 4/1912 | Vom Bruck | 292/145 |
| 1,391,896 | 9/1921 | Hiserodt | 312/348 |
| 2,364,604 | 12/1944 | Creager | 312/333 |
| 2,606,091 | 8/1952 | Buchy et al. | 312/349 |
| 2,678,866 | 5/1954 | Merrett | 312/349 |
| 3,026,149 | 3/1962 | Ruhnke | 312/333 |
| 3,138,416 | 6/1964 | Abramovich | 312/348 |
| 3,639,028 | 2/1972 | Black | 312/348 |
| 3,698,883 | 10/1972 | Fazio | 292/147 |
| 4,042,288 | 8/1977 | Litchfield | 312/330 R |

*Primary Examiner*—Victor N. Sakran
*Attorney, Agent, or Firm*—Marshall & Yeasting

[57] ABSTRACT

A drawer assembly comprising back and side wall panels of extruded construction each comprising upper and lower hollow sections interconnected by a web defining a longitudinal recess which, in the drawer side wall panels, is adapted for engagement with drawer runners mounted in a cabinet or the like in which the drawer is to be supported in use, the wall panels being interconnected at right angles to one another by corner pieces having projections engaging in the open ends of the upper and lower hollow sections of the panels, and stop devices slidably mounted on said web at opposite ends of the back panel for movement between retracted inoperative positions in which the stop devices are clear of the longitudinal recesses of the side wall panels and extended operative positions in which portions of the stop devices project across said recesses for engagement with abutment members carried by the drawer runners.

18 Claims, 8 Drawing Figures

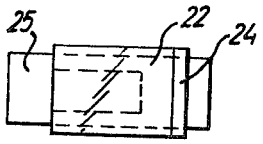
FIG. 3
FIG. 4
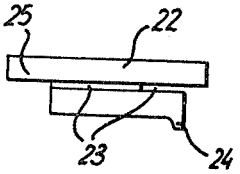
FIG. 5
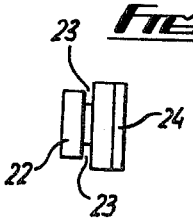
FIG. 8
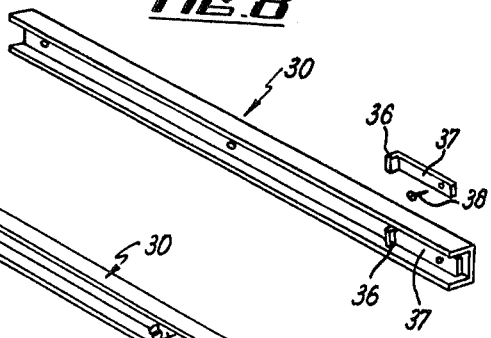
FIG. 7
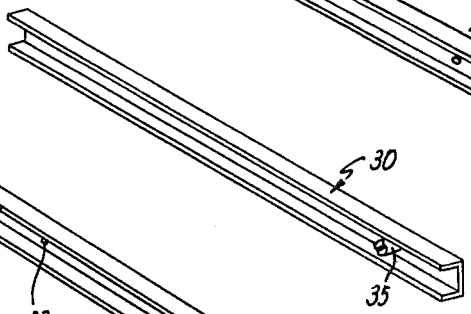
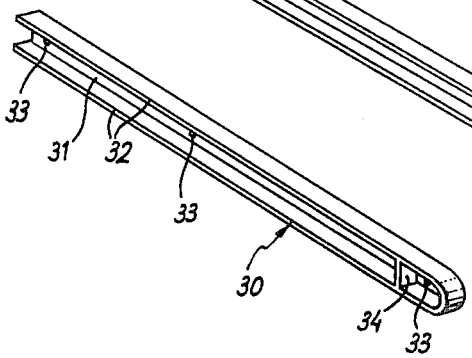
FIG. 6

DRAWER WITH STOP DEVICE

The invention relates to drawers and is expecially but not exclusively applicable to drawers of so-called "knock-down" form, that is to say which are supplied in separate parts for assembly by the purchasers.

It is often necessary for various reasons to incorporate fitments in the region of the rear corners of a drawer. In some instances the fitments are fixed but in other cases they require to be movable relative to the drawer. The attachment of such fitments presents problems, especially in relation to plastic drawers and in cases where the fitments require to be movable, and if the fitments comprise separable parts these can become detached and lost.

For example it is desirable in constructing drawers to provide some means which, when the drawer is installed in a cabinet or the like, will prevent complete withdrawal of the drawer during use. If some such means is not provided, accidental removal of a drawer can cause accidents and result in injury to the user or damage to the drawer or its contents. Hitherto it has been a difficulty in relation to drawers of knock-down form to provide stop means preventing complete withdrawal of the drawer from its cabinet. Although various drawer stop devices are known in connection with pre-assembled drawers, their adaptation to knock-down drawers has not generally met with success since purchasers have found the incorporation of the stop devices during assembly to be troublesome and the stop devices can readily be mis-placed before assembly.

According to one aspect of the present invention there is provided a drawer comprising back and side panels, the side panels incorporating runner grooves and the back and side panels being of hollow construction interconnected by corner pieces having projections engaged in the hollow portions of the associated panels, and a fitment removably mounted at one end of said back panel and retained against removal when the back panel and the associated side panel are assembled, said fitment including a portion which extends across the runner groove in the side panel.

The fitment may be slidably mounted on the back panel for movement between a retracted position in which said portion thereof is clear of the runner groove in the associated side panel and an operative position in which it extends into the groove.

The back panel may incorporate a longitudinal groove or recess similar to and aligned with the runner grooves in said side panels, said fitment being mounted in said groove or recess. The fitment may be engaged in an aperture formed in the base of the groove or recess and opening at one end thereof. Where the fitment is slidable the aperture may be elongated to permit the sliding movement.

Said portion of the fitment may comprise a stop member adapted to engage with a fixed abutment during sliding movement of the drawer relative to a cabinet or like supporting structure in which the drawer is mounted in use, whereby to prevent complete withdrawal of the drawer from the cabinet. Alternatively said portion of the fitment may comprise a guide member adapted to engage with a guide or runner member mounted in the cabinet and serving to support and guide the rear end of the drawer thereon during opening and closing movements.

Generally a similar fitment will be provided at both the rear corners of the drawer although in some cases a fitment may be provided at one of the rear corners only.

According to a further aspect of the invention there is provided a drawer having runner recesses formed in the side walls thereof and a stop member mounted at one end of the rear wall of the drawer for movement between an operative position in which the stop member extends across the runner recess in the associated side wall and a retracted position in which the stop member is withdrawn clear of the runner recess.

The invention also provides a drawer stop device comprising a body member provided with guide surfaces adapted for sliding connection with a drawer back and having an abutment or stop portion movable, by sliding of the body member, between a retracted position in which the stop portion is clear of the associated drawer side and an operative position in which the stop portion projects from the drawer side for engagement with an abutment mounted in the cabinet or the like in which the drawer is located in use.

Preferably the device is adapted to be mounted in a position corresponding to that of the runner grooves or recesses formed in the drawer sides, such that in the extended operative position the stop portion projects across the runner groove for engagement with an abutment provided on the drawer runner.

Preferably the drawer is of "knock-down" construction comprising extruded back and side panels of hollow construction interconnected by corner pieces having projections engaged in the hollow portions of the associated panels, stop devices being slidably mounted at opposite ends of the back panel. Thus the invention also provides a back panel for a drawer having drawer stop devices slidably mounted at opposite ends of the panel at a level corresponding to that of the drawer runner recesses in the associated side walls of the drawer, the stop members being movable between retracted positions clear of the ends of the rear wall panel and operative positions in which they project beyond the ends of the panel so as to be engageable in use with abutments carried by the drawer runners.

The invention also provides a drawer assembly comprising back and side wall panels of extruded construction each comprising upper and lower hollow sections interconnected by a web defining a longitudinal recess which, in the drawer side wall panels, is adapted for engagement with drawer runners mounted in a cabinet or the like in which the drawer is to be supported in use, the wall panels being interconnected at right angles to one another by corner pieces having projections engaging in the open ends of the upper and lower hollow sections of the panels, and stop devices slidably mounted on said web at opposite ends of the back panel for movement between retracted inoperative positions in which the stop devices are clear of the longitudinal recesses of the side wall panels and extended operative positions in which portions of the stop devices project across said recesses for engagement with abutment members carried by the drawer runners.

Preferably each stop device comprises a body portion having peripheral slots for sliding engagement with the edges of an aperture formed at the associated end of the web portion of the rear wall panel, the rear face of the body portion being provided with an extension which projects across the runner recess of the associated side wall panel when the stop device is in said operative position.

Preferably also the body portion of the stop device is provided with a projection for engagement by the user's thumb or finger to facilitate movement of the stop device between its retracted and extended positions.

Preferably also the peripheral slots formed in the body portion of the stop member are of chamfered form so as to resiliently grip the associated edges of the aperture in the wall panel whereby to provide a friction fit and prevent detachment of the stop device when the components of the drawer are in their knocked-down form.

According to a further aspect of the invention there is provided a drawer runner having a mounting web or flange by means of which the runner may be secured in an appropriate position to a cabinet or like structure in which a drawer is to be mounted, and a drawer-supporting web or flange projecting from the mounting web at right angles and on which the drawer is supported by means of runner grooves formed in the drawer sides, an abutment member projecting from one or both of said webs of the runner adjacent to the end thereof which is forwardmost in use for engagement with a stop member on the drawer.

The runner may be of L-shaped cross-section but is preferably of U-shaped channel section with the base of the U forming said mounting web.

The abutment member may be moulded integrally with the drawer runner or may comprise a separate member fitted thereto. In a preferred embodiment the abutment member comprises an enlarged head formed on a screw by means of which the runner is mounted in position in the cabinet.

Embodiments of the invention will now be described, by way of example only, with reference to the accompanying drawings in which:

FIGS. 3 to 5 are front, plan and end views respectively of the stop member; and FIGS. 6 to 8 are perspective views showing different forms of runner for use in association with the drawer shown in FIG. 1.

Figure 1:
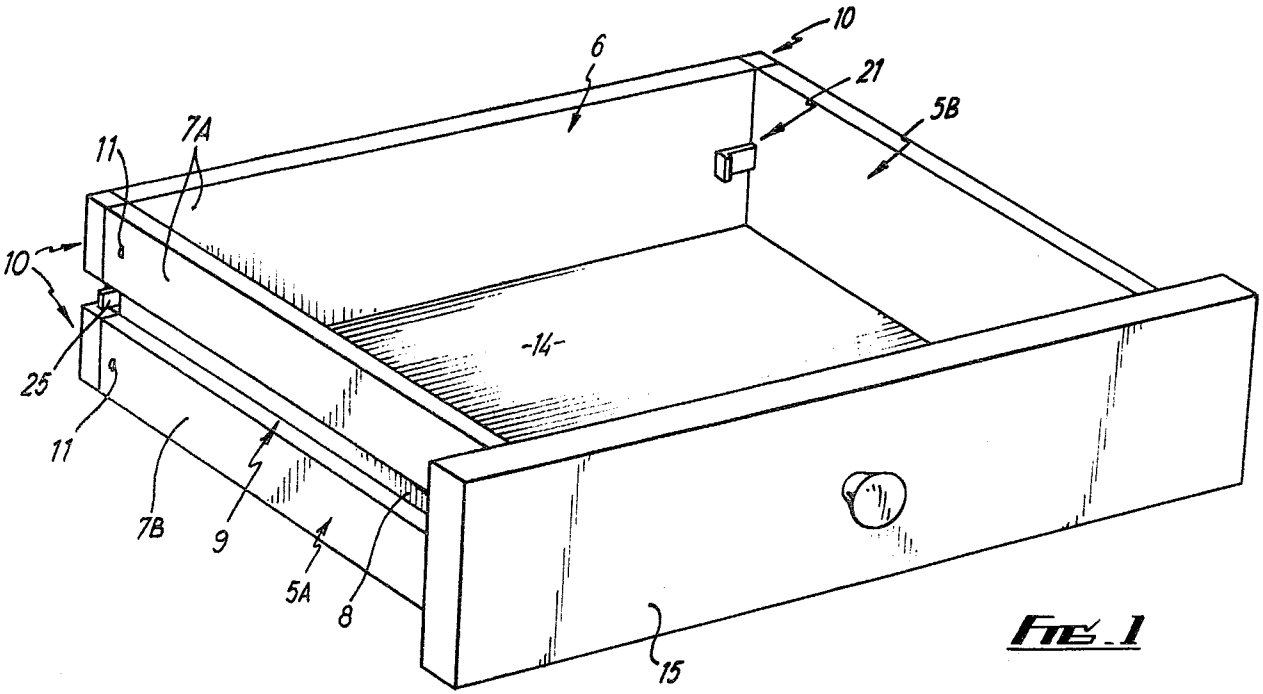
FIG. 1 is a perspective view of a drawer construction according to one embodiment of the invention.

Referring to FIG. 1, the drawer is of so-called "knock-down" construction and comprises identical side and back panels 5A, 5B and 6 of extruded plastics construction each comprising upper and lower hollow portions 7A, 7B interconnected by a web 8 defining a longitudinal groove or recess 9. The recesses 9 in the side panels 5A and 5B are adapted for sliding engagement with drawer runners mounted in a cabinet or other structure in which the drawer is to be supported in use. The side and back panels are interconnected by corner pieces 10 having projecting spigot portions (not shown) adapted to form a tight push-fit in the open ends of the upper and lower hollow portions of the side and back panels and provided with detents 11 which clip into engagement with complementary holes formed adjacent the ends of the wall panels to retain same in the assembled condition. The lower hollow sections of the wall panels are provided with recesses 13 (FIG. 2) in their inner faces which are adapted to accommodate the edges of a drawer bottom 14.

The front of the drawer comprises a facia board or panel 15 which may be of wooden or other construction and is attached to the remainder of the assembly by means of facia connectors (not shown) which are screwed or otherwise secured to the rear face of the drawer front and are provided with spigots and detents similar to those provided on the corner pieces which engage in the forward ends of the side wall panels 5A, 5B. The drawer front is also provided with a groove to accommodate the forward edge of the drawer bottom 14.

Figure 2:
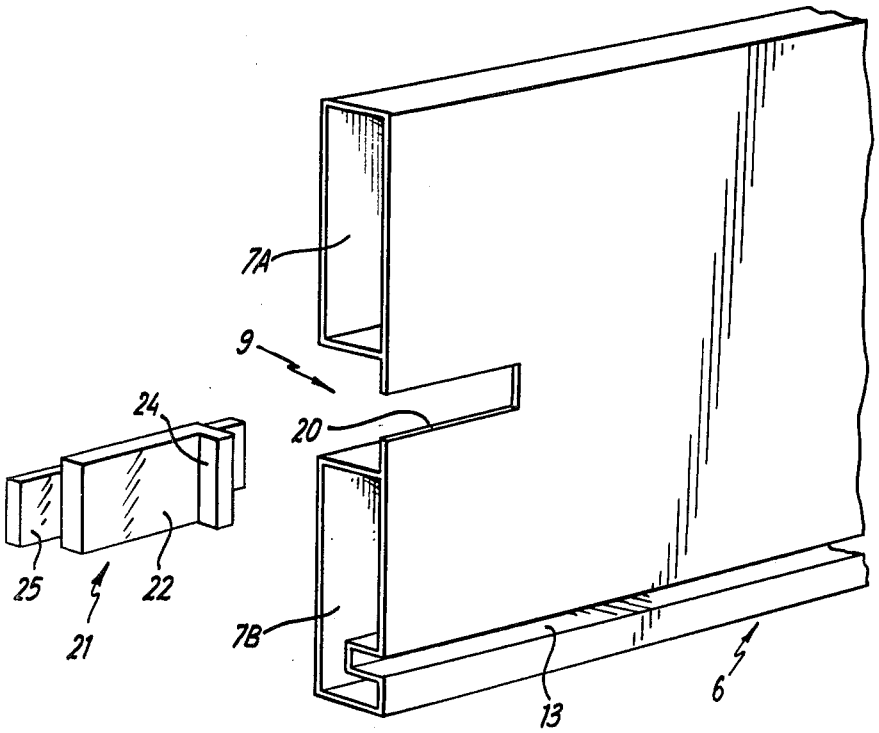
FIG. 2 is an enlarged fragmentary view of one end of the rear wall panel of the drawer showing the associated stop member detached therefrom.

As shown in FIG. 2, recesses or slots 20 are formed at the opposite ends of the web 8 interconnecting the upper and lower hollow sections of the back panel 6. These slots are adapted to accommodate drawer stop devices 21 each of which has a body portion 22 provided with grooves 23 at its upper, lower and inner edges for sliding engagement with the edge portions of the associated slot 20. Although not visible in the drawings, the grooves 23 in the stop devices 21 are of chamfered form so as to resiliently grip the associated edges of the slots 20 in the wall panel. This provides a tight friction fit and prevents detachment of the stop devices when the components of the drawer are in their knocked-down form. The inner face of the body portion of the stop member is provided with a projection or finger piece 24 to facilitate sliding movement. The outer or rear face of the body portion is provided with an outwardly directed extension 25 forming an abutment or stop portion.

The arrangement is such that the stop devices at the respective opposite ends of the back panel may be slid along their respective slots 20 between inoperative positions in which they are withdrawn inwardly clear of the sides of the drawer so that the stop members are clear of the drawer runner grooves, and operative positions, as shown in FIG. 1, in which they are moved outwardly so that the stop portions project across the runner grooves. In this position the end face of the inner portion of each body member abuts the inner face of the associated side wall panel of the drawer to limit the outward movement. When the stop devices are in their retracted positions the drawer may be engaged with the drawer runners and slid into position in the cabinet or the like. The stop devices are then moved outwardly to their operative positions and when the drawer is withdrawn from the cabinet the stop members engage abutments formed on the drawer runners as will now be described to prevent removal of the drawer from the cabinet.

Referring now to FIG. 6, there is shown a drawer runner 30 of channel shaped section having a vertical mounting web 31 and upper and lower horizontal webs 32. The drawer runner is secured in position by means of screws passing through a plurality of holes 33. The upper and lower horizontal webs 32 are interconnected near the forward end of the runner by a vertical web 34 moulded integrally with the runner and constituting an abutment which projects into the channel defined by the runner.

A similar runner is fitted at the opposite side of the drawer and the dimensions of the respective webs 34 are such that when the stop devices carried by the drawer back are moved into their outwardly projecting operative positions the stop portions abut the webs 34 when the drawer is drawn forward and thus prevent complete removal of the drawer from the cabinet.

FIG. 7 shows an alternative form of runner in which the abutment is formed by an enlarged head 35 on one of the screws by means of which the runner is secured to the cabinet or the like. FIG. 8 shows a further embodiment in which the abutment 36 is carried by a separate member 37 secured to the runner by one of the fixing screws 38, the member 37 being shown both detached from the runner and located in its operative position. In the FIGS. 7 and 8 embodiments the runner can comprise a simple U-section extrusion.

In use the drawer is supplied to the purchaser in knocked-down form with the stop devices 21 engaged in the slots 20 at the ends of the back panel. Following assembly the stop devices are retained in their withdrawn inoperative positions and the drawer is engaged with the drawer runners and slid into positon in the cabinet or the like. After initial engagement of the drawer the stop devices are moved outwardly to their operative positions and thus engage behind the abutments on the runners at each side of the cabinet to prevent removal of the drawer during normal opening and closing movement. If it is desired subsequently to remove the drawer the stop devices are simply moved to their inner disengaged positions, thereby withdrawing the stop portions clear of the abutments on the runners and enabling the drawer to be removed.

Various modifications may be made without departing from the invention. For example different forms of slidable stop devices may be incorporated and various forms of abutment may be provided on the drawer runners. The drawer may also be differently constructed, and though primarily intended for use with knock-down drawers of plastic construction the invention could also be used with other forms of drawer. Moreover the fitments which project across the runner grooves need not be stop members. They could be guide members adapted to engage with a guide or runner member mounted in the cabinet and serving to support and guide the rear end of the drawer on the fixed guide or runner member during opening and closing movements of the drawer. It should also be appreciated that while fitments would normally be provided at both rear corners of the drawer, in some cases a fitment may be provided at one corner only. Moreover the fitment could be fixed in position instead of being slidable between operative and retracted positions.

We claim:

1. A drawer comprising back and side panels, the side panels incorporating runner grooves and the back and side panels being of hollow construction interconnected by corner pieces having projections engaged in the hollow portions of the associated panels, and a fitment removably mounted at one end of said back panel and retained against removal when the back panel an the associated side panel are assembled, said fitment including a portion which extends across the runner groove in the side panel.

2. A drawer according to claim 1 wherein said back panel incorporates a longitudinal groove or recess similar to and aligned with the runner grooves in said side panels, said fitment being mounted in said groove or recess.

3. A drawer according to claim 2 wherein said fitment is engaged in an aperture formed in the base of the groove or recess and opening at one end thereof.

4. A drawer according to claim 1 wherein said fitment is slidably mounted on the back panel for movement between a retracted position in which said portion thereof is clear of the runner groove in the associated side panel and an operative position in which it extends into the groove.

5. A drawer according to claim 3 wherein said fitment is slidably mounted on the back panel for movement between a retracted position in which said portion thereof is clear of the runner groove in the associated side panel and an operative position in which it extends into the groove.

6. A drawer according to claim 5 wherein said aperture is elongated to permit sliding of said fitment.

7. A drawer according to claim 1 wherein said portion of said fitment comprises a stop member adapted to engage with a fixed abutment during sliding movement of the drawer relative to a cabinet or like supporting structure in which the drawer is mounted in use, whereby to prevent complete withdrawal of the drawer from the cabinet.

8. A drawer according to claim 1 wherein said portion of the fitment comprises a guide member adapted to engage with a guide or runner member mounted in the cabinet and serving to support and guide the rear end of the drawer thereon during opening and closing movements.

9. A drawer according to claim 1 wherein a fitment is provided at both the rear corners of the drawer.

10. In a drawer having a back defining an open-ended slot, a drawer stop device comprising a body member provided with grooves receiving edges of the slot for sliding connection with the drawer back and having an abutment or stop portion movable, by sliding of the body member, between a retracted position in which the stop portion is clear of the associated drawer side and an operative position in which the stop portion projects from the drawer side for engagement with an abutment mounted in the cabinet or the like in which the drawer is located in use.

11. A drawer stop device according to claim 10 which is adapted to be mounted in a position corresponding to that of the runner grooves or recesses formed in the drawer sides, such that in the extended operative position the stop portion projects across the runner groove for engagement with an abutment provided on the drawer runner.

12. A drawer according to claim 9 which is of "knock-down" construction comprising extruded back and side panels of hollow construction interconnected by corner pieces having projections engaged in the hollow portions of the associated panels, stop devices being slidably mounted at opposite ends of the back panel.

13. A drawer incorporating a stop device according to claim 11 which is of "knock-down" construction comprising extruded back and side panels of hollow construction interconnected by corner pieces having projections engaged in the hollow portions of the associated panels, stop devices being slidably mounted at opposite ends of the back panel.

14. A back panel for a drawer having drawer stop devices slidably mounted at opposite ends of the panel at a level corresponding to that of the drawer runner recesses in the associated side walls of the drawer, the stop members being movable between retracted positions clear of the ends of the rear wall panel and operative positions in which they project beyond the ends of the panel so as to be engageable in use with abutments carried by the drawer runners.

15. A drawer assembly comprising back and side wall panels of extruded construction each comprising upper and lower hollow sections interconnected by a web defining a longitudinal recess which, in the drawer side wall panels, is adapted for engagement with drawer runners mounted in a cabinet or the like in which the drawer is to be supported in use, the wall panels being interconnected at right angles to one another by corner pieces having projections engaging in the open ends of the upper and lower hollow sections of the panels, and stop devices slidably mounted on said web at opposite ends of the back panel for movement between retracted inoperative positions in which the stop devices are clear of the longitudinal recesses of the side wall panels and extended operative positions in which portions of the stop devices project across said recesses for engagement with abutment members carried by the drawer runners.

16. A drawer according to claim 15 wherein each stop device comprises a body portion having peripheral slots for sliding engagement with the edges of an aperture formed at the associated end of the web portion of the rear wall panel, the rear face of the body portion being provided with an extension which projects across the runner recess of the associated side wall panel when the stop device is in said operative position.

17. A drawer according to claim 16 wherein the body portion of the stop device is provided with a projection for engagement by the user's thumb or finger to facilitate movement of the stop device between its retracted and extended positions.

18. A drawer according to claim 16 wherein the peripheral slots formed in the body portion of the stop member are of chamfered form so as to resiliently grip the associated edges of the aperture in the wall panel whereby to provide a friction fit.

* * * * *